US010442602B2

(12) United States Patent
Farco

(10) Patent No.: US 10,442,602 B2
(45) **Date of Patent: *Oct. 15, 2019**

(54) PHARMACEUTICAL TRAY

(71) Applicant: Joseph Farco, Dobbs Ferry, NY (US)

(72) Inventor: Joseph Farco, Dobbs Ferry, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/168,238

(22) Filed: May 30, 2016

(65) Prior Publication Data

US 2016/0318695 A1 Nov. 3, 2016

Related U.S. Application Data

(63) Continuation of application No. 14/016,062, filed on Aug. 31, 2013, now Pat. No. 9,352,895, which is a continuation of application No. 13/443,890, filed on Apr. 11, 2012, now Pat. No. 8,556,078.

(51) Int. Cl.
*A61J 1/03* (2006.01)
*B65D 83/04* (2006.01)

(52) U.S. Cl.
CPC ..... *B65D 83/0445* (2013.01); *A61J 1/03* (2013.01)

(58) Field of Classification Search
CPC .. B65D 83/0445; B65D 75/327; B65D 83/00; B65D 83/0083; B65D 83/0094
USPC ..... 206/534.1
See application file for complete search history.

(56) References Cited

U.S. PATENT DOCUMENTS

D165,856 S * 2/1952 Mytinger ..... D3/203.3
D225,467 S * 12/1972 Burke ..... D24/230
3,912,082 A * 10/1975 Gerner ..... B65D 75/327 206/462
4,872,559 A * 10/1989 Schoon ..... A61J 1/03 206/534
4,889,236 A * 12/1989 Bartell ..... B65D 75/327 206/528
5,119,560 A 6/1992 Noble
D243,798 S 3/1997 Swartz
D423,798 S 5/2000 Willardson
6,442,962 B1 * 9/2002 Gaetke ..... A47F 10/06 62/457.6
6,520,332 B1 2/2003 Barmore et al.
D574,665 S 8/2008 James
D585,703 S 2/2009 French
(Continued)

FOREIGN PATENT DOCUMENTS

AU 2006905064 A1 2/2006
EP 1002744 A1 5/2000
(Continued)

OTHER PUBLICATIONS

Prosecution history of U.S. Appl. No. 14/449,127 (including all IDS, cited prior art references and applicable translations, PCT search reports and written opinions in same).

*Primary Examiner* — Anthony D Stashick
*Assistant Examiner* — Raven Collins

(57) ABSTRACT

A flexible tray has at least one flexible wall extending about at least one medicine held in place by a flexible material, the at least one medicine being selected from the group consisting of pills, capsules, tablets, caplets, and gel caps and mechanical means to connect the at least one flexible wall of the tray to the flexible material so that the tray holds the at least one medicine below the top of the at least one flexible wall.

20 Claims, 11 Drawing Sheets

(56) References Cited

U.S. PATENT DOCUMENTS

| | | | | |
|---|---|---|---|---|
| 7,823,742 | B2 * | 11/2010 | Valentine | B65D 75/327 206/469 |
| 8,556,078 | B1 | 10/2013 | Farco | |
| 9,278,792 | B2 | 3/2016 | Linssen | |
| 9,352,895 | B2 | 5/2016 | Farco | |
| 2007/0054525 | A1 | 3/2007 | Jones et al. | |
| 2007/0251983 | A1 | 11/2007 | Freeze | |
| 2007/0272586 | A1 | 11/2007 | Hession | |
| 2009/0167041 | A1 | 7/2009 | James | |
| 2009/0206100 | A1 | 8/2009 | Mazur | |
| 2010/0252478 | A1 | 10/2010 | Beecroft | |
| 2011/0042375 | A1 | 2/2011 | Jones | |
| 2011/0114527 | A1 | 5/2011 | Thomas | |
| 2011/0127320 | A1 | 6/2011 | Sams | |
| 2011/0226765 | A1 | 9/2011 | Gelardi | |
| 2012/0012497 | A1 | 1/2012 | Weston | |
| 2012/0234701 | A1 | 9/2012 | Albrecht | |

FOREIGN PATENT DOCUMENTS

| | | | |
|---|---|---|---|
| WO | 2005068304 | A2 | 7/2005 |
| WO | 2007095694 | A1 | 8/2007 |
| WO | 2008061026 | A2 | 5/2008 |
| WO | 2012011941 | A1 | 1/2012 |
| WO | 2012063213 | A1 | 5/2013 |
| WO | 2013070506 | A1 | 5/2013 |
| WO | 2013151806 | A1 | 10/2013 |

* cited by examiner

PHARMACEUTICAL TRAY

RELATED APPLICATIONS

This application is a continuation of U.S. patent application Ser. No. 14/016,062, filed on Aug. 31, 2013, which is a continuation of U.S. patent application Ser. No. 13/443,890, filed on Apr. 11, 2012, now U.S. Pat. No. 8,556,078, to which priority is hereby claimed and the disclosures of each of which being incorporated herein by reference in their entirety.

FIELD OF THE INVENTION

Disclosed are embodiments of the invention that relate to, among other things, assisting healthcare professionals and consumers with discriminating between medications and identifying medications.

BACKGROUND

Pharmacists and other healthcare professionals fill prescription medications for patients and other consumers. While trying to ensure timely delivery of desired medications, healthcare providers lack the time and resources to confirm the type, amount and accuracy of all dispensed medications. There is a need to provide healthcare professionals with means to better achieve accurate dispensation of medications.

Consumers of medications, including bottled pills and other drugs, may not always be aware of the contents of the medication containers. Consumers lack quick and effective means to determine the contents of their medications. There is a need to provide consumers with means to ensure accuracy in reviewing their dispensed medications.

SUMMARY OF THE INVENTION

A bendable tray may hold medicines in wells formed in its surface to discriminate medicines, discriminate medicine amounts and pour such medicines back into a container.

A tray may have a flexible floor and one or more flexible walls capable of deforming when the floor is bent. Upon deforming, the flexible wall may allow medicines within the walls of the tray to exit the tray.

The flexible walls of a tray may be shaped and sized to operate as a tray container for medicines nestled in a flexible floor and a pouring apparatus when the flexible floor is bent.

Figure 1:
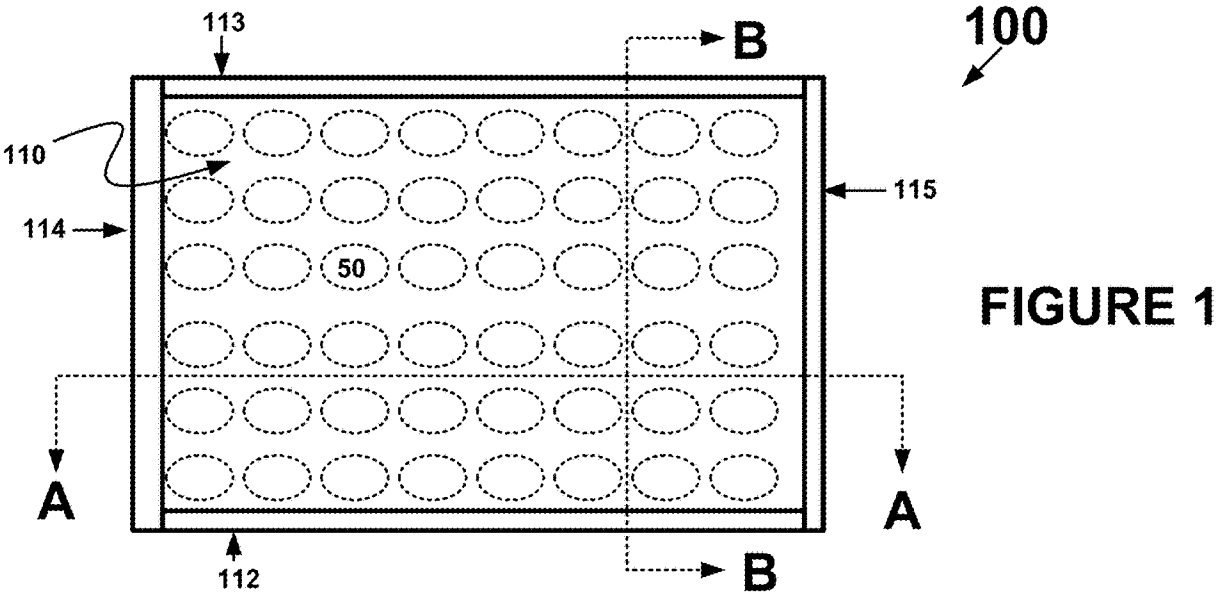
FIGS. 1, 1A and 1B illustrate multiple vantage points of an exemplary embodiment of a tray.

In the drawings like characters of reference indicate corresponding parts in the different figures. The drawing figures, elements and other depictions should be understood as being interchangeable and may be combined in any like manner in accordance with the disclosures and objectives recited herein.

DETAILED DESCRIPTION

Figure 1B:
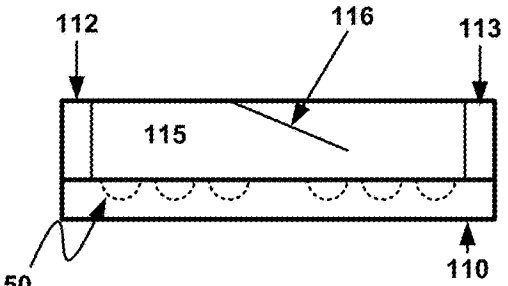

With reference to FIG. 1, a tray 100 may comprise a floor 110, left side-wall 112, right side-wall 113, front wall 114, and back wall 115. Disposed within walls 112-115 surrounding floor 110, e.g., the interior of the tray 100, may be a plurality of bays 50. Each of left- and right-side walls 112 and 113, respectively, may extend from floor 110 and have a height, thickness, shape, curvature and any other mechanical attributes sufficient to hold contents within tray 100. For example, side wall 112, sidewall 113, front wall 114, and back wall 115, in any combination, may be shaped to preclude objects that can fit in bays 50 from leaving tray 100 when tray 100 may be shuffled, moved, bent or made to slide along a surface. Left- and right-sidewall 112, 113, respectively, may be equal in all dimensions and substantially rectilinear in shape. Front wall 114 may also extend from floor 110 and be mechanically similar to left- and right-sidewalls 112, 113, respectively. Alternatively, front wall 114 may possess different shapes and configurations as may be the case for any of the disclosed embodiments of an exemplary tray. Back wall 115, which may be similar to the other walls previously described, may be a continuous piece of material, or back wall 115 may possess a cut 116 across a width or height that allows it to have two distinct regions (FIG. 1B). For example, back wall 115 may have a diagonal cut 116 forming a region to the right of the cut 116 and a complementary region to the left of cut 116. If tray 100 is bent on floor 110 or any of its walls 112 and/or 113, cut 116 may allow one of the wall 115 regions to be more distal from the interior side of front wall 114 than the other region of wall 115. An exemplary view of such compression formation of outer wall 115 with cut 116 may be seen, for example, in FIGS. 5C, 5D and 5G.

Figure 1A:
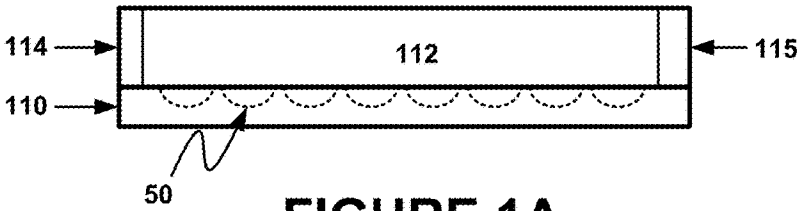

FIG. 1A shows a side view of an exemplary tray 100 facing left side wall 112. Floor 110 is shown as a solid material with a series of bays 50 molded, carved or etched into its surface. Alternatively, bays 50 may be formed as a result of molding floor 110 using a preset mold for different bay sizes according to molding techniques known to those skilled in art. According to this alternative, floor 110 with bays 50 may be made out of one continuous material. Floor 110 may be made out of any one of the following: rubber, Teflon, latex, silicone, polyurethanes and any other elastomers known to those skilled in art. Floor 110 may be formed by molding such flexible materials using extrusion, injection molding, structural foam molding, blow molding, rotational molding, thermoforming, compression molding, transfer molding, casting, dip molding, dip molding and vulcanization and other like techniques known to those skilled in art. However, floor 110 may be made out of non-flexible materials to the extent these materials can plastically deform.

Front wall 114 may be subsequently attached to floor 110 using adhesives, heat bonding, and mechanical attachments such as sewing, wire links, staples or clamps, etc. Alternatively, front wall 114 may be molded along with floor 110 so that the two are made from one continuous piece of material, e.g., front wall 114 may be molded from the same cast in which floor 110 may be molded. In either embodiment, front wall 114 may be formed from similar materials and in similar fashion to floor 110. As may be discussed with respect to other embodiments disclosed herein, front wall 114 may be shaped and configured in numerous manners to allow for operation of the various disclosed embodiments. An exemplary front wall 114 may be flexible and made out of an elastomer.

Left side wall 112 and right side wall 113 may be formed in similar fashion and from similar materials as front wall 114 and/or floor 110. In one embodiment, left side wall 112 and right side wall 113 may be molded from the same material as floor 110 and front wall 114, thereby being formed via a multiple dimension molding process. Alternatively, either of the various side walls may be joined to floor 110 via adhesives, heat bonding, mechanical attachments such as sewing, wire links, staples or clamps, etc. Both side wall 112 and 113 may be shaped and molded to allow for flexible operations using floor 110 and front wall 114, as may be disclosed herein.

In FIG. 1, left and right side walls 112, 113 are integrally attached to back wall 115. Alternatively, where cut 116 is involved, as in FIG. 1B, left side wall 112 is integrally attached to left region of wall 115 while right side wall 113 is integrally attached to a right region of wall 115. Either of the left and/or right regions of back wall 115 may be separately attached to floor 110 and their respective side walls, or may be molded together and attached to floor 110 and either of side walls 112, 113.

For a back wall 115 without cut 116, a single piece of material may be used to form the back wall of tray 100. Alternatively, walls 112, 115 and 113 may be made of a single material and attached to floor 110 as previously described. Further all walls 112-115 may be made of a single material and attached to floor 110 as previously described. Still further, all portions of tray 100 may be molded together as one continuous piece of material. A mold of a tray 100 may be made by sculpting or designing a preform that will have the dimensions of the floor 110, walls 112-115 and bays 50 desired. An exemplary mold 90 may be illustrated with reference to FIGS. 12 and 12A. According to the exemplary embodiment illustrated by FIG. 12, mold 90 may possess hills 91 and trough 92 into which moldable material may be poured, extruded or otherwise set. An adjustable divider 93 and divide 94 may be situated at the top of mold 90 to form cuts like cut 116 in molded objects being formed with mold 90. Divide 94 may have numerous configurations including straight, curved or zigzag.

Figure 12A:
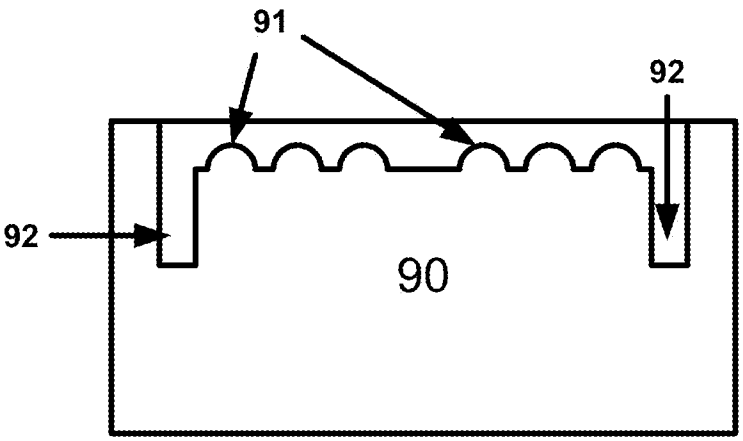
FIGS. 12 and 12A illustrate exemplary molds for the manufacture of an exemplary tray.
Figure 12:
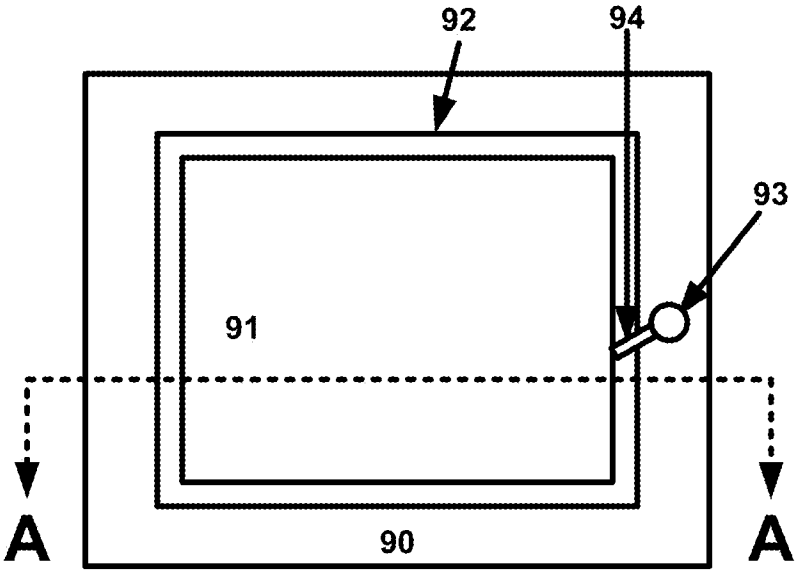

FIG. 12A illustrates an exemplary mold 90 from a different vantage point. In FIG. 12A, hills 91 may be part of mold 90 or alternatively the hills 91 may be capable of being replaced from a given mold 90 (by screwing in a hill 91 or snapping in place) so a single mold 90 may be used with different hills 91 and hill 91 patterns. Troughs 92 lay on either side of hills 91 and upon molding may form one or more of the front, side and back walls of an exemplary tray 100. To manufacture cut 116 in back wall 115, a unified back wall may be molded and cut using cutting tools such as blades or lasers on completed molds (such as a mold completed using an exemplary mold 90 illustrated in FIG. 12 using the methods and tools illustrated in FIGS. 5H-J and related disclosures) or the cut 116 may be made by specialized molds with dividers (as illustrated in FIG. 12 with divider 93 and divide 94).

The walls of tray 100 enclose floor 110 and the various bays 50 formed in floor 110's surface. Bays 50 may be any shape or size and orientation within floor 110 for fitting a form of matter, such as, for example, pills, capsules, food stuffs, mechanical components, ammunition, or medicinal matter. A more detailed discussion of the bays 50 may be found with reference to FIGS. 10 and 10A.

Walls 112-115, bays 50 and floor 110 may be made of flexible material and may be produced on a single mold or formed substantially simultaneously from the same starting material to allow each of the walls 112-115 and floor 110 to be a continuous piece of material. FIGS. 12 and 12A may illustrate one such mold for producing a tray 100 made of a single solid piece of flexible material. In this way, a tray 100 manufactured in this fashion may have a lower cost of production and more stability when bent and flexed in operation (as may be discussed further). The trays 200-500 and all related embodiments may similarly be formed, fabricated and designed as tray 100.

Figure 2:
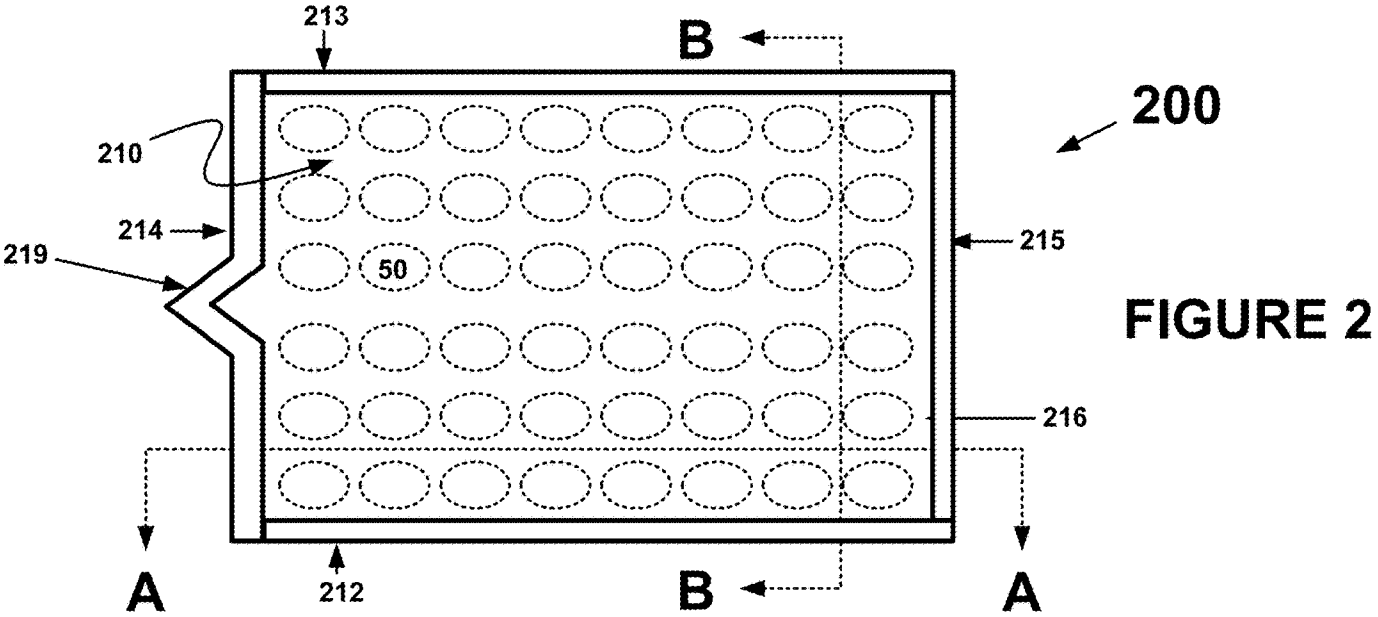
FIGS. 2, 2A and 2B illustrate multiple vantage points of another exemplary embodiment of a tray.

FIG. 2 illustrates another embodiment of a tray 200 which has a floor 210, bays 50 embedded in floor 210, front wall 214, left and right side walls 212 and 213, respectively, and back wall 115, which may possess a cut 216 (similar to cut 116) in its surface (not shown). As previously discussed, the fabrication, design and manufacture of any of walls 212-215, cut 216, bays 50 and floor 210 may be the same as those for walls 112-115, cut 116, bays 50 and floor 110, of FIGS. 1, 1A and 1B.

Figure 2B:
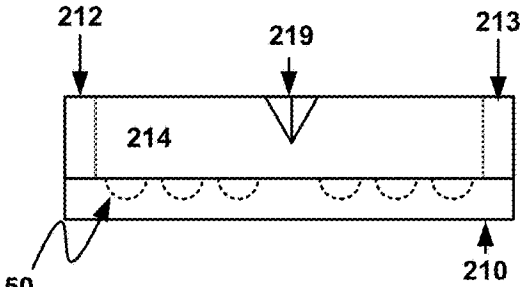
Figure 2A:
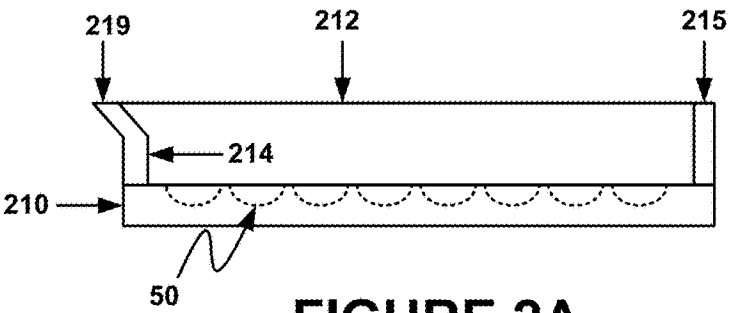

According to FIG. 2, front wall 214 may have a spout 219. Spout 219 may be part of front wall 214's molded surface or may be attached to front wall 214 via any of attachment mechanisms disclosed herein. As can be seen in FIGS. 2A and 2B, spout 219 may be a certain height above floor 110 and bays 50 so as not to remove the existence of front wall 214 below spout 219 in its entirety. While spout 219 is illustrated as coextensive with front wall 114, it may also be molded or formed in any shape or fashion that would allow contents within walls 212-215 to pour out of tray 200. Spout 219 may be made of the same materials and in like fashion to any of the various components of tray 100 or tray 200.

Figure 3:
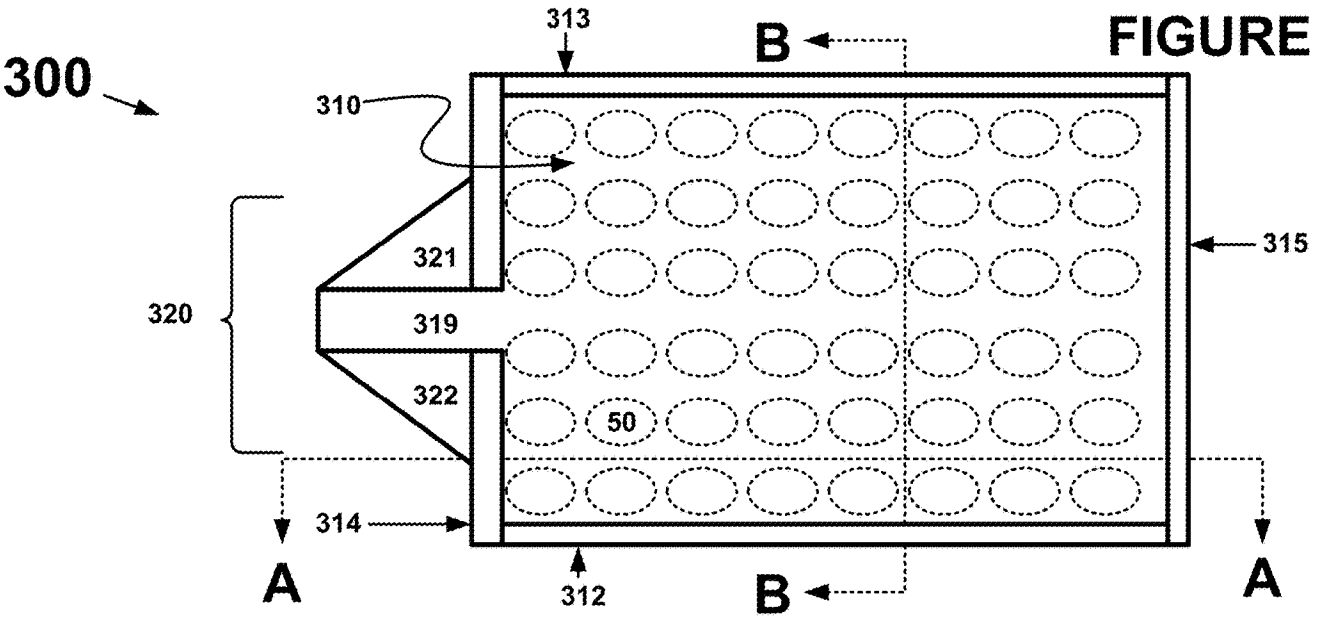
FIGS. 3, 3A and 3B illustrate multiple vantage points of yet another exemplary embodiment of a tray.

FIG. 3 illustrates a tray 300 which has a floor 310, bays 50 embedded in floor 310, front wall 314, left and right side walls 312 and 313, respectively, and back wall 315, which may possess a cut 316 (similar to cut 116) in its surface (not shown). As previously discussed, the fabrication, design and manufacture of any of walls 312-315, cut 316, bays 50 and floor 310 may be the same as those for walls 112-115, cut 116, bays 50 and floor 110, of FIGS. 1, 1A and 1B and/or for walls 212-215, cut 216, bays 50 and floor 210, of FIGS. 2, 2A and 2B.

Figure 3B:
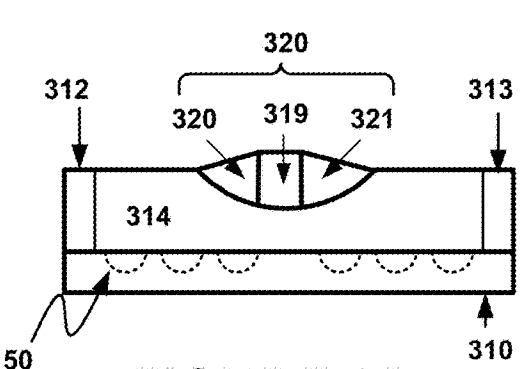
Figure 3A:
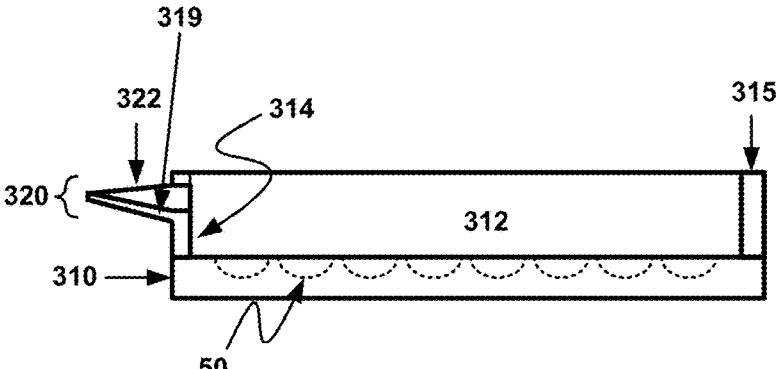

According to FIG. 3, front wall 314 may have a funneled body 320 comprised of flap 319 and left- and right wings 322 and 321, respectively, extending distally from front wall 314. Funneled body 320 may be part of front wall 314's molded surface or may be attached to front wall 314 via any of attachment mechanisms disclosed herein. As can be seen in FIGS. 3A and 3B, funneled body 320 may be a certain height above floor 310 and bays 50 so as not to remove the existence of front wall 314 below funneled body 320 in its entirety. While funneled body 320 is illustrated as coextensive with front wall 314, it may also be molded or formed in any shape or fashion that would allow contents within walls 312-315 to pour out of tray 300. Funneled body 320 may be made of the same materials and in like fashion to any of the various components of trays 100, 200 or 300.

Funneled body 320 may also have variable surfaces on its various portions, 319, 321 and 322. For example, flap 319 may be of similar texture to floor 310 while left- and right wings 322 and 321 may be of a different texture. Additionally when made of a flexible material, funneled body 320 may be bent so that wings 322 and 321 in combination with flap 319 form a funnel for delivery of contents within walls 312-215. Further discussion of such an embodiment may be had with respect to FIG. 6B.

Figure 4:
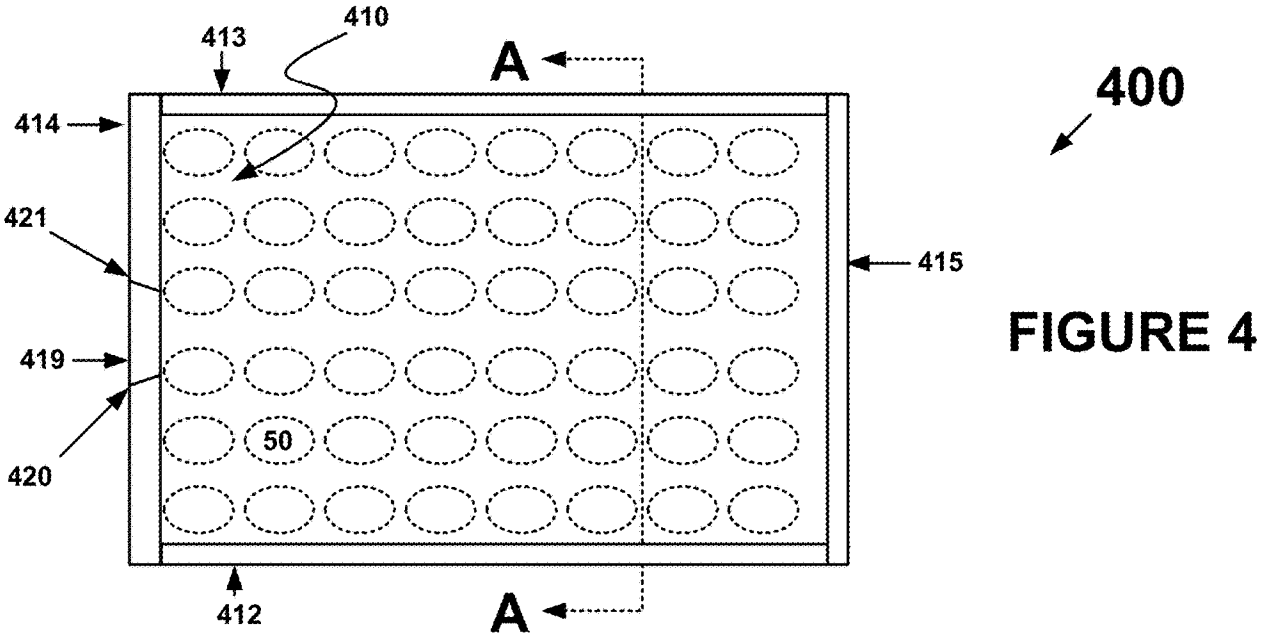
FIGS. 4 and 4A illustrate multiple vantage points of an alternative exemplary embodiment of a tray.

FIG. 4 illustrates another embodiment of a tray 400 which has a floor 410, bays 50 embedded in floor 410, front wall 414, left and right side walls 412 and 413, respectively, and back wall 415, which may possess a cut 416 (similar to cut 116) in its surface (not shown). As previously discussed, the fabrication, design and manufacture of any of walls 412-415, cut 416, bays 50 and floor 410 may be the same as those for walls 112-115, cut 116, bays 50 and floor 110, of FIGS. 1, 1A and 1B and/or for walls 212-215, cut 116, bays 50 and floor 210, of FIGS. 2, 2A and 2B and/or for walls 312-315, cut 316, bays 50 and floor 310, of FIGS. 3, 3A and 3B.

Figure 4A:
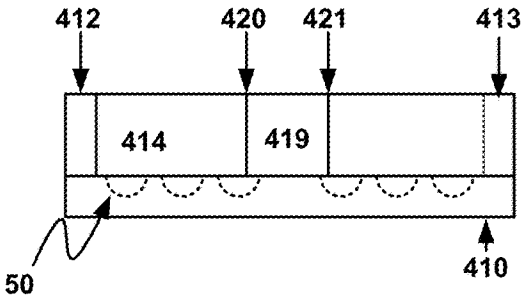

According to FIG. 4, front wall 414 may have a door 419 created by left and right slits 420 and 421, respectively, extending partially or completely through a height of front wall 414. As can be seen in FIG. 4A, door 419 may extend the entire height of front wall 414. Alternatively, slits 420 and 421 may extend partially from the top of front wall 414 toward floor 410, so that door 419 may be a certain height above floor 410 and bays 50. In this way, door 419 may be formed so as not to remove the existence of the portion of front wall 414 below door 419 in its entirety. Alternatively, door 419 may be made of different material from front wall 414 and be attached to floor 410 in any manner previously described. Alternatively, in embodiments where front wall 414 is made of a different material than floor 410, door 419 may be integrally molded with floor 410 such that the two components are made of a single continuous material.

As previously described, slits 420 and 421 may be made by any cutting or material removal means known to those skilled in art, such as by blades, lasers or via the particular mold in which tray 400 is formed. One such exemplary mold may be mold 90 in FIG. 12 with multiple dividers 93. Further discussion of door 419 and its operation may be had with respect to FIGS. 7, 8 and 9. Further, slits 420 and 421 may also be configured and fabricated in like manner to cut 116, as described herein.

The various trays 100, 200, 300 and 400 described may be combined or used in combination. For example, it may be recognized, that a tray 100 according to the disclosures related to FIGS. 1, 1A and 1B may be formed into tray 400 following molding and subsequent treatment with a cutting tool to form slits 420 and 421 in front wall 114/414. An exemplary cutting tool and process may be illustrated in FIGS. 5H-J. Alternatively, slits 420 and 421 may be made on either side of spout 219 of tray 200 to create additional advantages to having a door 419 with the curvature of spout 219 in its inner surface facing floor 210. Further, multiple doors 419 may be made in front wall 414 to permit certain contents within walls 412-415 to exit from tray 400. In this manner, front walls 114, 214, 314 and 414 of the various embodiments may serve as selective exits for objects found within the walls of trays 100, 200, 300 and 400.

Figure 5:
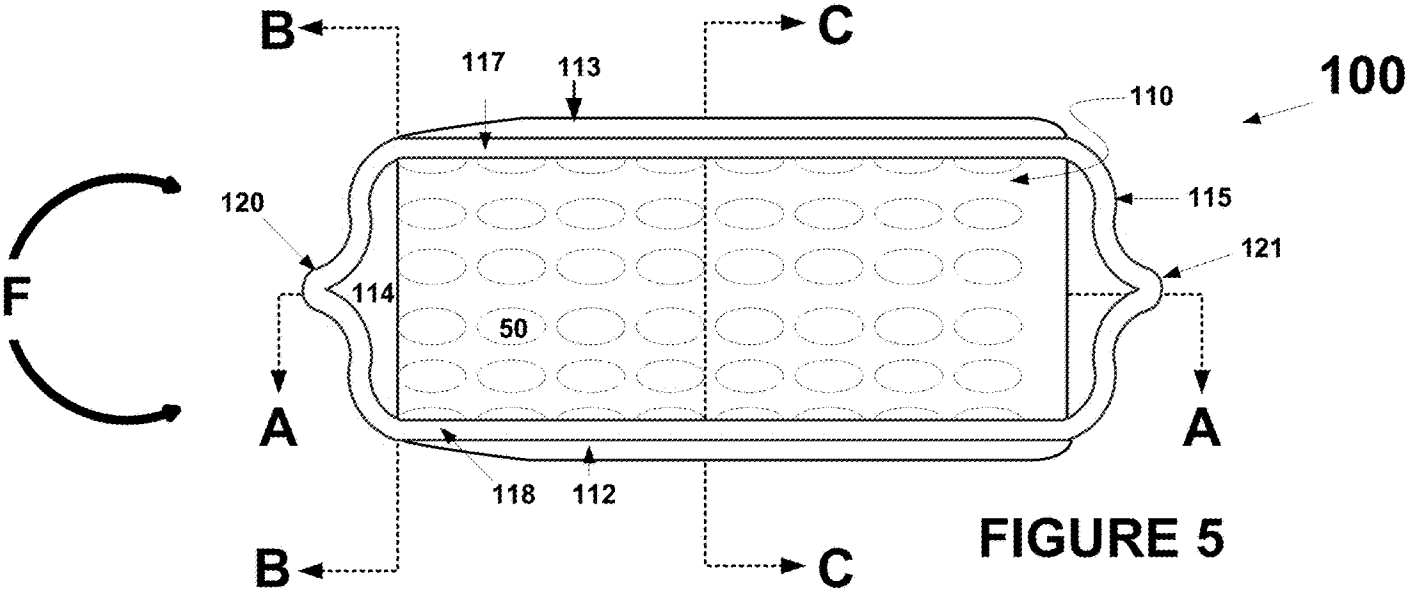
FIGS. 5, 5A and 5B illustrate multiple vantage points of an operative configuration of exemplary embodiments of a tray.
Figure 5B:
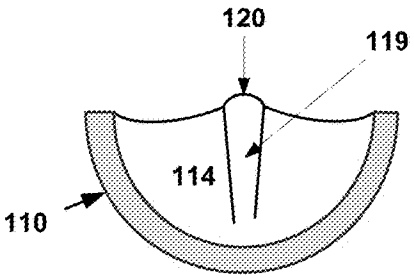

FIG. 5 is an illustrative embodiment of an operation using tray 100. As a force F is applied to floor 110 of tray 100, floor 110 and flexible walls 112-115 may bend and/or plastically deform. According to FIG. 5, a force F may be applied to bend floor 110 or, may be applied to left and right side walls 112 and 113, respectively, causing them to bend floor 110. The upper edges 117 and 118 of right and left side walls 113 and 112, respectively, may be illustrated as converging toward the center of floor 110 due to the bending force F. This may also be seen in FIG. 5A.

Figure 5A:
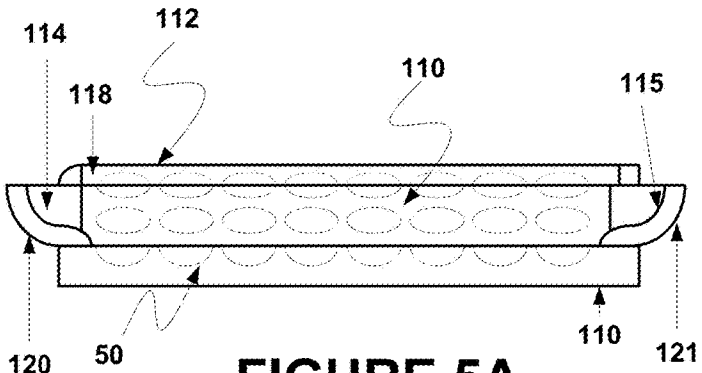

FIG. 5A shows the deformation along the left side of tray 100 due to force F on either the left side of floor 110 or left side wall 112. As a force is continuously applied, bays 50 may be seen to converge about axis of bending of floor 110. Due to the convergence of floor 110's left and right portions about the bending axis, bays 50 located at the peripheries of floor 110 may be seen to reduce in size and/or undergo changes in shape to release whatever contents they may possess prior to application of force F. In this way, bending of floor 110 may act to deform floor 110 and release contents held in bays 50.

FIGS. 5 and 5A also illustrate that as floor 110 deforms due to force F, front wall 114 may deform so that its edges produce a lip 120. Unlike spout 219, lip 120 may result from application of force F on the floor 110 or side walls 113 and/or 112 and without application of such force, lip 120 may not exist. Thus, front wall 114's flexible nature permits the existence of lip 120 so that contents within tray 100 under deformed conditions may pour out of tray 100. A more detailed view of lip 120 may be had with reference to FIG. 5B. In FIG. 5B, lip 120 may possess a ramp 119 leading from the lower portion of front wall 114 to the edge of lip 120. The texture of ramp 119 may be smooth or soft to permit sliding of contents from within tray 100 to a destination outside of tray 100.

Application of force F may have numerous effects on back wall 115 depending on the shape and configuration of wall 115. In FIG. 5A, application of force to a uniform back wall 115 may create a lip 121 in its surface similar to that created with respect to front wall 114. Alternatively, a back wall with a cut 116 may not form a lip 121 because the material that otherwise would make up lip 121 may, instead, overlap.

Figure 5C:
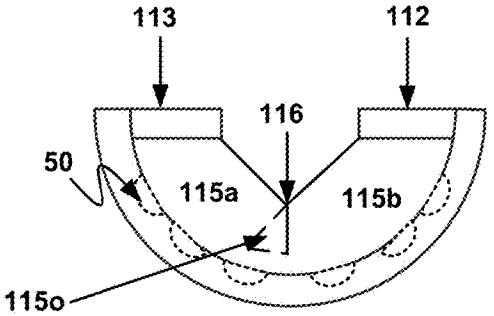
FIGS. 5C, 5D, 5E, 5F and 5G illustrate multiple vantage points of another operative configuration of exemplary embodiments of a tray.

Alternatively, as illustrated in FIGS. 5C-F, cut 116 may allow right polyhedral component 115*a* and left polyhedral component 115*b* of wall 115 to slide past one another during compression to maintain a back wall surface but allow for reduction in a back wall area. An exemplary sliding configuration may be seen in FIGS. 5C and 5F. In FIG. 5C, under application of a force F on floor 110 by virtue of forces on side walls 112 and 113, right polyhedral component 115*a* of back wall 115 may deflect inwardly towards the interior of tray 100 while left polyhedral component 115*b* of back wall 115 deflects distally from the interior of tray 100. According to an exemplary embodiment illustrated in FIGS. 5C and 5G, where each of the polyhedral wall components of 115 cross cut 116, the more distal of the components may form wall overlap 115*o*. Overlap 115*o* may protrude from wall 115 surface or may remain in substantial contact with the exterior surface of the less distal polyhedral component of wall 115.

Figure 5D:
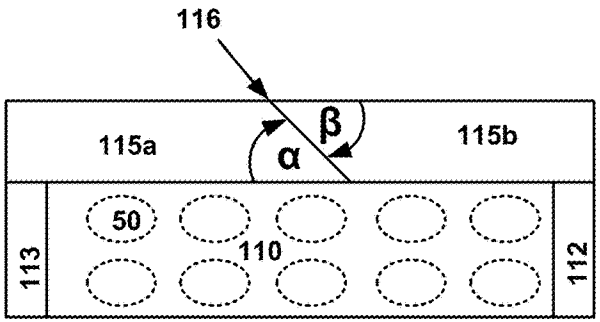

The number, angle, texture and dimension of cut(s) 116 may influence the overlap 115*o* and ultimate form of reduced-area back wall 115 after a compression event. Cuts 116 resulting in smooth edges between components 115*a* and 115*b* may allow for more predictable overlapping of components, or leaving one component edge smooth while the other not as smooth may also make for predictable overlapping of components. Another factor to consider for the overlapping of components 115*a* and 115*b* may be angles at which cut 116 is made. For example, as shown in FIG. 5D, cut 116 may be made at an angle α from the interior surface of back wall 115, e.g., the surface of back wall 115 facing front wall 114. Cut 116 may simultaneously be at substantially the same or different angle β from the exterior surface of back wall 115, e.g., the surface facing away from front wall 114. Different cut angles α and β may segment back wall 115 which may not be rectilinear in shape, and thus may have differently shaped surfaces depending on application and need of tray 100.

In another embodiment where α is much less than β, 115*o* may be comprised of component 115*b* of back wall 115 during a compression event. However, in an alternative embodiment, an example of which may be illustrated using FIG. 5E, as β approaches 90 degrees or greater, a zigzag cut 116 may exist in back wall 115 such that a portion of cut edge of side wall component 115*b* interlocks with a complementary cut edge of side wall component 115*a*. For zigzag cut 116, one advantage may be an interlocking arrangement of back wall 115 components, e.g., 115*a* and 115*b*, which may unlock when subjected to compression forces such as force F on floor 110 or sidewalls 112 and 113. When force F is removed from tray 100, the flexible material of back wall 115 and its various components may allow for the components to re-lock into their original positions.

Figure 5E:
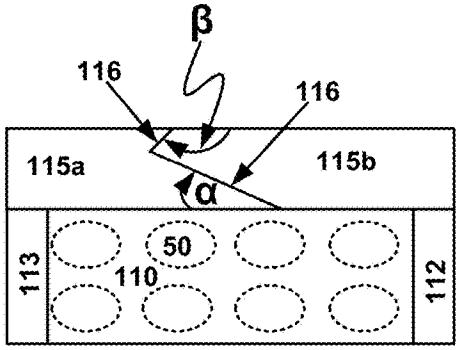
Figure 5F:
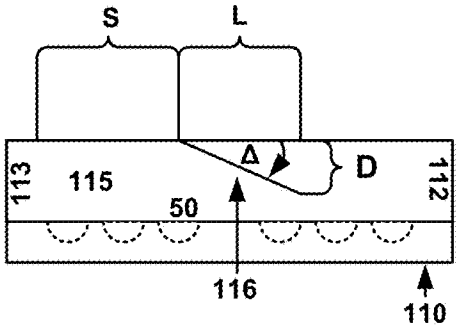

Other considerations related to the type and extent of compression arrangement of back wall 115 may be the distance from the side wall 112 or 113 that cut 116 may be made, angle at which cut 116 may be made and the depth of the cut 116 through the height of back wall 115. An exemplary view of back wall 115 in FIG. 5F illustrates a back wall 115 with cut 116 through its surface. Cut 116 may be any shape through back wall 115's cross section (e.g., single angle shapes such as in FIGS. 5C-5D or zigzags as in FIG. 5E). As shown in FIG. 5F, cut 116 may be a certain distance S from side wall 112 or 113 (in FIG. 5F, the distance S may be measured from side wall 113). Cut 116 may extend over a length L of back wall 115 and be cut a depth D into back wall 115. Cut 116 may also be cut at an angle Δ from a surface of back wall 115. While Δ is shown as a single angle, those skilled in art may appreciate that other exemplary cut 116 angles are possible with flexible material cutting tools, e.g., arced cuts, zigzags or a combination of each. Further, an exemplary cutting tool may need to be shaped to a particular cut 116 cross section (e.g., a zigzag as shown in FIG. 5E) before cutting into back wall 115 at angle Δ. Thus, according to numerous aspects of tray embodiments with cuts 116, customization of cutting tool shapes, mold shapes or either of the two in combination may be utilized to achieve a desired cut 116 in back wall 115.

Figure 5G:
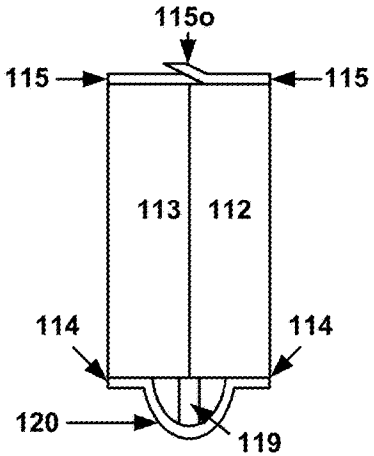
Figure 5H:
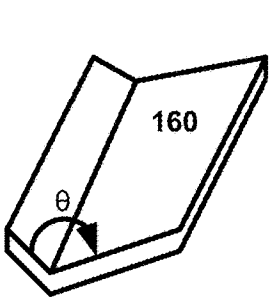
FIGS. 5H, 5I and 5J illustrate an exemplary tool to fabricate and an exemplary method of fabricating various exemplary embodiments of a tray.
Figure 5I:
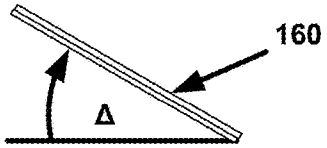
Figure 5I:
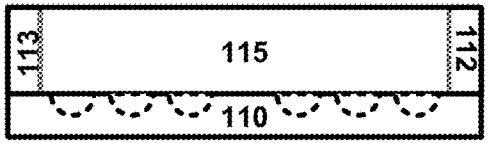
Figure 5J:
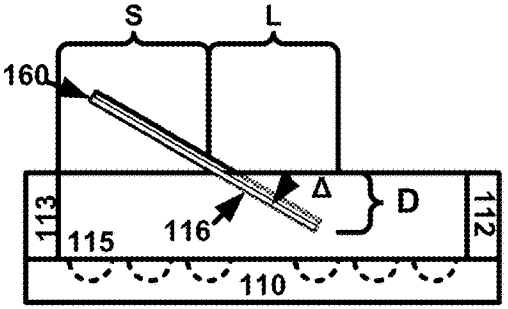

For example, after molding a tray 100 with a unified back wall 115, a cutting tool such as a blade, may be shaped to have its sharp surface bent into a v-like cross section with an angle θ of 180°−β+α or any other angle or angles to accomplish a zigzag configuration shown in FIG. 5E. An exemplary tool for making cut 116 may be illustrated in FIG. 5H. Cutting tool 160 may have one or more angles θ which may be used to form the particular cut 116 in back wall 115 of tray 100. According to an exemplary fabrication array in FIG. 5I, placing cutting tool 160 at an angle Δ from a surface of unified back wall 115, a cut 116 may be made through unified back wall 115 at a desired distance S and for a length L and depth D into the unified back wall 115 (e.g., FIG. 5J). An exemplary completed cutting procedure may be further illustrated in FIG. 5J, whereby back wall 115 may have one or more components, e.g., components 115*a* and 115*b*, created as a result of cutting by tool 160 through a surface of back wall 115.

Where a force F is applied to tray 100, a bending in floor 110 may occur about an axis of bending such that each of the various walls, bays and surfaces of tray 100 flexibly deform. FIG. 5G illustrates an exemplary result of application of force F to either of floor 110 and/or walls 112, 113 of tray 100. In one embodiment, sidewalls 112 and 113 converge such that lip 120 forms in front wall 114 and back wall 115 achieves an overlap 115*o* maintaining a wall for contents within tray 100. According to such an embodiment, as illustrated in FIG. 5G, contents within bays 50 of tray 100 may exit tray 100 by pouring those contents out of folded tray 100 via lip 120 formed in front wall 114. In one aspect of this embodiment, contents may travel from within tray 100 down ramp 119 and depart tray 100 through lip 120. While FIG. 5G may show complete convergence of side walls 112 and 113, in practice, any degree of convergence may be achieved to accomplish the task of permitting contents of tray 100 to exit from the tray. Further, while FIG. 5G illustrates embodiments where back wall 115 has cut 116, it may be that such bent trays could also have unified back walls 115 with their own lips 121 formed as a result of such bending. In those cases, those skilled in art would recognize that either back wall 115 or front wall 114 may be used to allow contents of tray 100 to exit via lips 121 and 120, respectively.

Figure 6B:
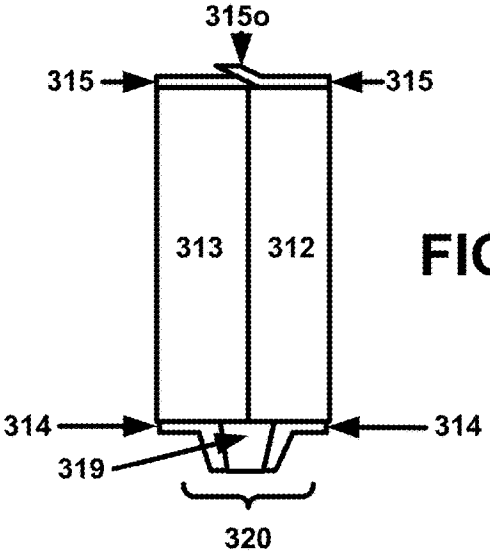
FIGS. 6A and 6B illustrate additional operative configurations of exemplary embodiments of a tray.
Figure 6A:
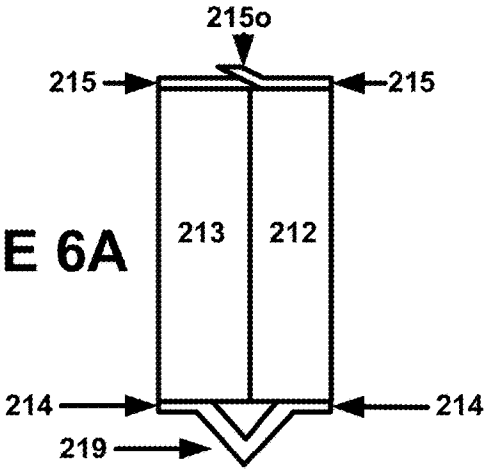

FIGS. 6A and 6B, illustrate embodiments of trays 200 and 300 as disclosed in FIGS. 2 and 3 under force F on their respective floors 210, 310 and/or side walls 212, 213 and 312, 313. The disclosures related to the various components of tray 100 apply equally to trays 200 and 300. However, as illustrated in FIG. 6A, front wall 214 possesses a spout 219 which may protrude further from the exterior surface of front wall 214 as force F is applied to floor 210. Spout 219 may be a distance above floor 210 so that contents stored within bays 50 of floor 210 would not immediately fall out of folded tray 200 unless tray 200 was inclined at a certain angle. In this way, spout 219 may permit exit for contents of tray 200 when the entire folded tray is tilted in a direction. Spout 219 may permit any number of the contents in tray 200 to exit from it and it may be understood that spout 219 may be any shape or texture. In one example, spout 219 is made out of the same materials as any other component of tray 200. Rather than a lip form in front wall 214, spout 219 may pre-exist the deformation of tray 200 and be shaped for easy pouring of tray 200's contents, e.g., medicine tablets or other pills. Force F on tray 200 may also have similar effects on back wall 215, by causing a similar form of overlap 215*o* due to cut 216 (not shown).

FIG. 6B illustrates tray 300 under force F. Unlike in a relaxed state where tray 300 has flap 319 and wings 321 and 322 (FIGS. 3, 3A and 3B), a bent tray 300 has a funnel 320 formed from bending of wings 321 and 322 with floor 310 and front wall 314. Thus, folding of flap 319 and wings 321-322, respectively, as a result of force F, may allow a bent tray 300 to funnel contents (e.g., medicines, pills, capsules) from within tray 300's interior walls out and into a target container or onto a target location.

Figure 7:
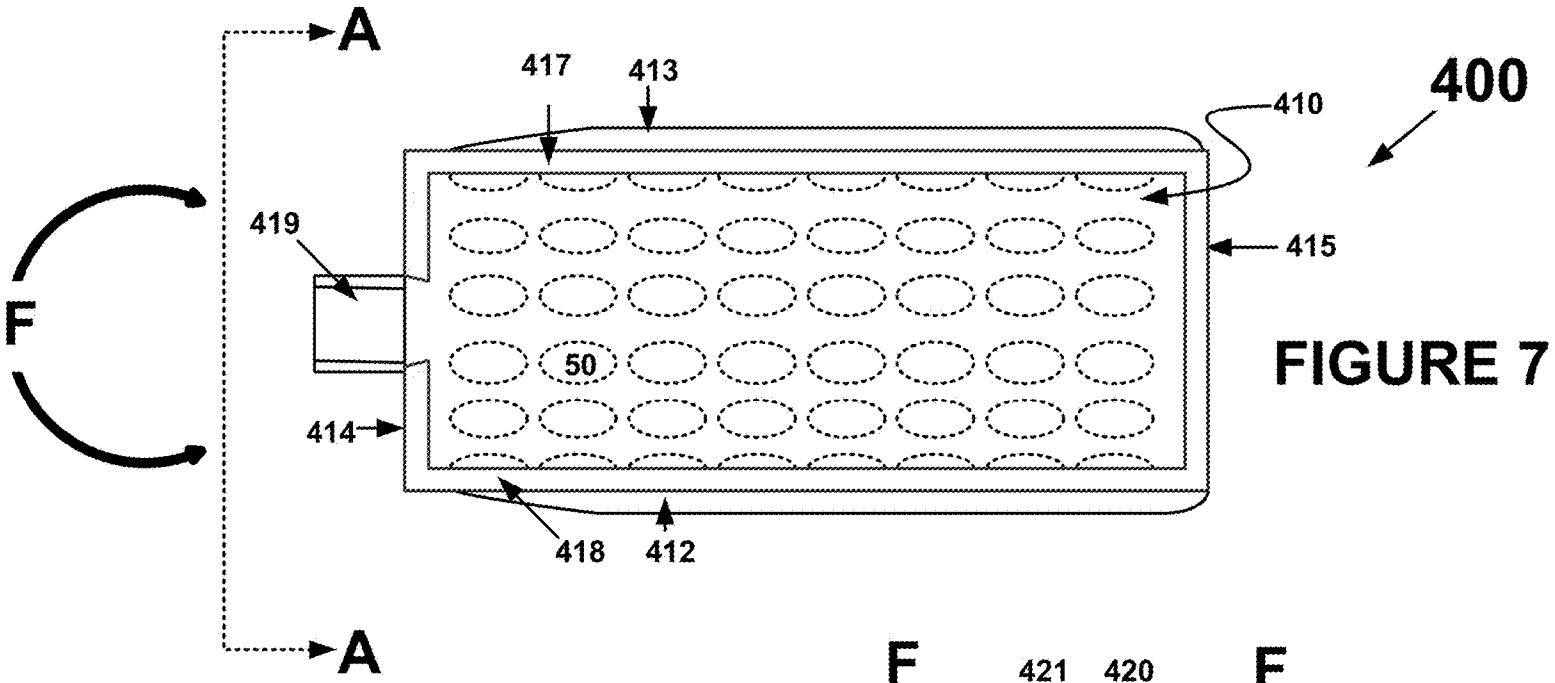
FIGS. 7, 7A and 7B illustrate additional operative configurations of yet another exemplary embodiment of a tray.
Figure 7B:
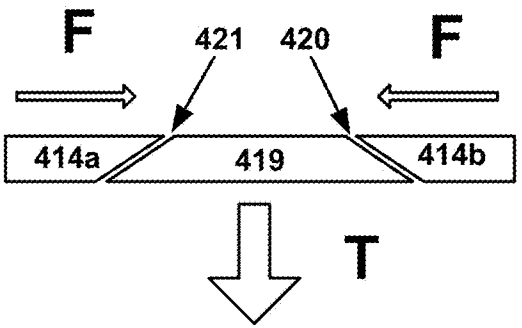
Figure 7A:
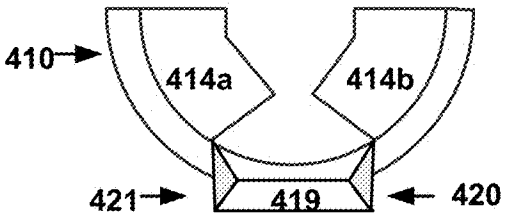

In another exemplary embodiment illustrated in FIG. 7, tray 400 receiving force F on its floor 410 and/or its left and right side walls 412 and 413, respectively, may have its left and right wall edges 418 and 417, respectively, converge towards a bending axis along floor 410. While force F on floor 410 may cause side walls 412 and 413 to converge at their edges 418 and 417, respectively, force F may also open door 419 made in front wall 414. Referring to FIG. 7A, a bent floor 410 may cause front wall segments 414*a* and 414*b* to displace. As wall segments 414*a* and 414*b* displace their respective slits 421 and 422 permit movement of door 419 from its location when no force F is applied. The type, depth and angle of slits 421 and/or 422 may be configured in like fashion to cut 116. Thus, while slits 421 and/or 422 are shown as single angle cuts, they may alternatively be zigzags, arcs or a combination of the two. For example, a zigzag slit 421 and/or 422 may serve as a "lock" between zigzag edges in front wall component 414*a/b* and door 419 that may not disengage with its complementary zigzag edge until acted upon by force F.

The size, shape and angle of slits 421, 422 may control to what extent door 419 may open in reaction to convergence of front wall components 421*a* and/or 421*b*. In an exemplary front wall 414 arrangement, FIG. 7B illustrates how a trapezoidal front wall 419 may move due to convergence force T which may derive from force F. Similar to surfaces on either side of cut 116 with respect to back wall 115, surfaces on either side of slits 420 and/or 421 may be made smooth or rough depending on application. Those skilled in art may recognize that the numerous features of cut 116 described above are equally applicable to the formation and operation of slits 421 and/or 422. Thus, the same or similar cutting tool 160 and method used to make cut 116 (FIGS. 5H-J) may also be used to make slits 420 and/or 421. In an embodiment where tray 400 is made from a single mold of material, multiple cutting operations may result in both cut 116 and slits 421 and 422. Alternatively, the same cutting tool or tool arrangements may be utilized to form any of cut 116, slit 421 and/or slit 422.

Figure 8:
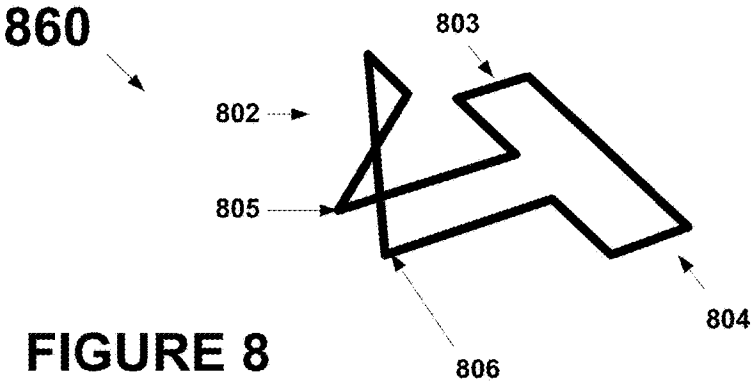
FIG. 8 illustrates a construct for operation with exemplary embodiments of a tray.
Figure 9:
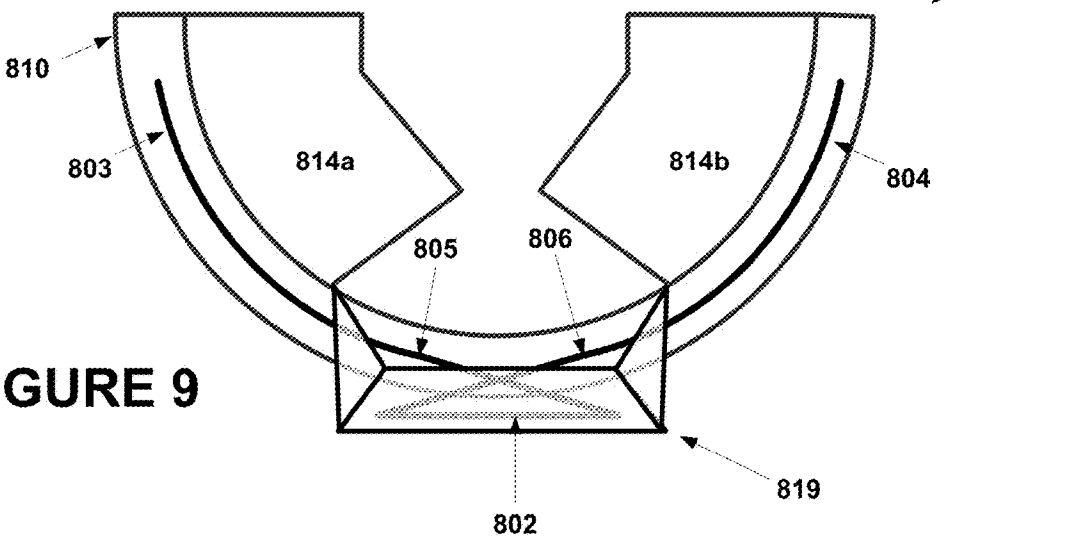
FIG. 9 illustrates an operative configuration of an exemplary construct for operation with exemplary embodiments of a tray.

FIGS. 8 and 9 illustrate another form of controlling opening of door 419 of tray 400 or another exemplary tray 800 having a floor 810, front wall components 814*a* and 814*b*, and door 819. FIG. 8 illustrates an exemplary latch skeleton 860 made of a wire or other substantially flexible material which quickly regains its original shape after release of compression.

According to an exemplary latch skeleton 860, right and left arms 803 and 804 extend across a width similar to a width of floor 810. Extending from right and left arms 803 and 804 are right and left elbows 805 and 806, respectively. A brace 802 may be formed from the remaining ends of the wire used to make skeleton 860. In an exemplary latch skeleton 860, the combination of elbows 805 and 806 serve as the latch while brace 802 may be embedded in door 419 or door 819 so that bending at arms 803 and 804 may cause door 419 or 418 with embedded brace 802 to bow forward in response to such bending. As illustrated in FIG. 9, bending of floor 810 with embedded skeleton arms 803 and 804 causes convergence of front wall components 814*a* and 814*b* about the bending axis and cause bowing of elbows 805 and 806. As elbows 805 and 806 bow in response to bending at arms 803 and 804, door 819 moves with brace 802 and opens in response to bending of floor 810 holding the encapsulated latch skeleton. Use of latch skeletons embedded in trays 800 may provide additional mechanical capabilities to open and close doors 819 via floor 810 bending.

Latch skeleton 860 may be encapsulated within the material used to make any of the trays described herein, including tray 800. Latch skeleton 860 may be placed in the liquid flexible material prior to molding of tray 800 and then allowed to cool within material. Those skilled in art may recognize that tray 800 may be formed by pouring liquefied rubber into a mold and then placing latch skeleton 860 into the liquefied rubber so that the rubber cools about the skeleton 860. In this way, skeleton 860 may be embedded in tray 800. The size, shape and orientation of latch skeleton 860 may impact its location of placement and time of placement in the tray 800 molding process. An exemplary skeleton 860 may be placed in the mold so that its brace 802 may be located in the same trough in which door 819 may form and arms 803 and 804 and elbows 805 and 806 may be embedded below the surface of floor 810. With reference to FIG. 12A, brace 802 may be situated in trough 92 while the remainder of latch skeleton 860 is held above hills 91 while it is coated in tray 800 materials during fabrication. While the latch skeleton 860 illustrated is shown, other forms of compression/decompression structures made out of molded wire may be readily apparent to those skilled in art which may accomplish the task of opening and closing a molded door 819 upon bending of a floor 810.

In each of the various tray embodiments described, floor 110, 210, 310, 410 and 810 may contain more than one bay 50, shaped and sized to hold a particular content. Bays 50 may be provided in floor 110 of an exemplary tray in columns and rows equaling to 30, 60, 90 or any other multiple necessary for a given application.

Figure 10:
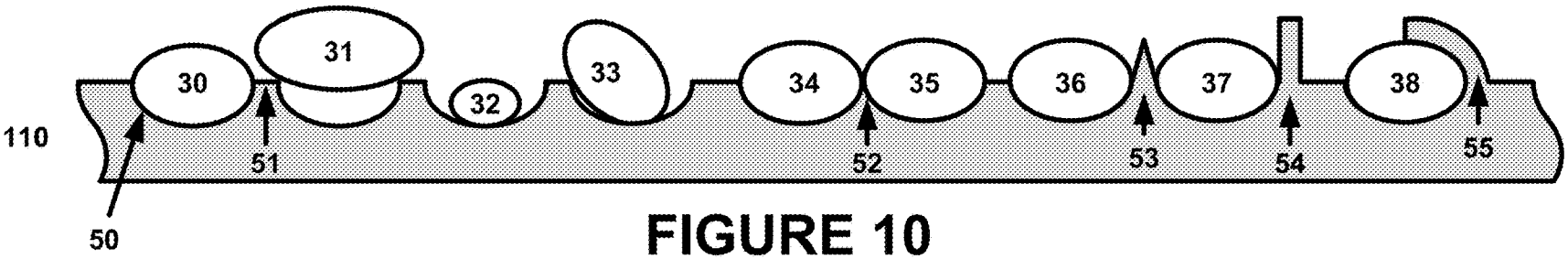
FIGS. 10 and 10*a* illustrate an exemplary utilization of embodiments of a tray.

In an exemplary embodiment illustrated in FIG. 10, bay 50 may hold a particular medicine 30. Medicine 30 may take the form of pills, tablets, capsules, caplets, suppositories or gel caps. Medicine 30 may sit within bay 50 in any manner. In one embodiment, an exemplary medicine 30 in the form of a pill may be situated so that a hemisphere may be visible when inside bay 50. Bay 50 may be shaped so that a particular pill 30 may fit within it. The number of bays 50 may correlate to the number of pills 30 an exemplary tray should hold, e.g., 30, 60 and 90 pill prescription containers. All bays 50 of a particular tray may be designed to hold a particular sized and shaped pill 30 or may hold assortments of such pills, depending on applications.

As illustrated in FIG. 10, each bay 50 may hold a pill 30, and in set numbers and arrangements, a tray 100 of a number of bays 50 may hold a number of pills corresponding to a prescription or regimen provided by a pharmacist or a doctor. For example, a tray 100 may have thirty bays 50 to account for a thirty-day supply of a pill 30. When checking to see whether a given prescription has the correct supply, pouring the contents onto tray 100 and seeing whether each bay 50 of tray 100 is filled by a pill may confirm that the prescription container has the requisite number of pills for the patient. After use, tray 100 may be bent according to any of aforementioned bending embodiments described above and emptied back into the prescription container. While tray 100 is referenced in the following embodiments, any and all trays described herein may similarly be used in accordance with the disclosures related to FIGS. 10-10A, 11 and 12.

Bays 50 may also be used to discriminate whether all pills in a container are the same. Bays 50 of tray 100 may accomplish this pill discrimination mechanism via their size, shape or with reference to a model pill 40 which indicates how a correct pill should be situated in a bay 50 of a given tray. In this manner, different trays 100 may be molded to have bays 50 that fit a particular type of pill or medication, e.g., unique trays for Lipitor® and unique trays for Zoloft®. Thus, a practitioner can use a tray 100 to scrutinize a mixed container of pills to determine which should belong in the container and which should be excluded.

Figure 10A:
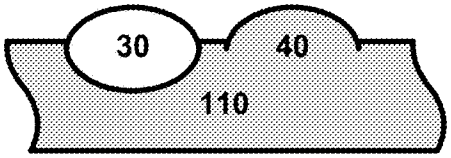

As shown in FIG. 10A, model pill 40 may be molded into the surface of floor 110 of tray 100 during fabrication. Along with other molds in tray 100 surface, model pill 40 allows users of tray 100 to determine whether a given pill 30 matches with model pill 40. An incorrect pill may not resemble model pill 40 and may be excluded.

Where an exemplary tray as described in the various embodiments disclosed herein contains multiple bays 50 to hold pills 30, persons buying or seeking to observe medications may see whether a particular prescription container has the requisite number and requisite type of pills 30. Were a prescription container to hold more than the prescribed number of pills 30, an exemplary tray may enable identification of an inaccurate number of pills 30. For example, where a prescription is for 30 pills, a tray with 30 bays may be used to ensure that 30 pills fill the 30 bays. If all the bays 50 of a tray are filled, any excess may be poured out of the tray via any of the various bending embodiments previously described. Excess pills may be poured back into a medicine holder or back into a bottle via the lip 119, spout 219, funnel 320 or door 419 via one or more or a combination of the various embodiments and methodologies related to these items of an exemplary tray According to the exemplary embodiment of tray 100 floor 110 in FIG. 10, bay 50's size and shape may exclude larger pills 31 such that a larger pill 31 may not embed itself in bay 50 because of a bay barrier 51 or because bay 50 is not properly shaped. A user of a tray may quickly recognize that a pill 31 stands out among a majority of pills 30. Smaller pills 32 may readily be seen as lacking a substantially tight fit in bay 50 upon comparison to other properly sized pills 30. Both larger pills 31 and smaller pills 32 may be distinguishable when compared to a model pill 40 formed in the surface of floor 110.

However, where a properly sized pill 30 may otherwise be improperly situated in floor 110, e.g., pill 33, shuffling tray 100 or using a brush or pharmacy spatula (not shown) to cause pill 33 to be properly situated in its bay may be used to ensure proper pill arrangement. The disclosed embodiments may be used with any type of brush or pharmacy spatula.

In an exemplary embodiment, repetitive shuffling of tray 100 may move pill 33 into a position so that it is situated in bay 50 like pill 30. In another example, a spatula may be moved across the surface of floor 110 to move pills into their bays 50. Using a pharmacy spatula or other tool known to those skilled in art to gently arrange pills 30 and 33 after a pour allows both proper situation of the correct pills in bays 50 and may alert the user to the presence of incorrect pills in tray 100. A large pill 31 would not fit in a bay 50 after being shuffled or moved with a spatula and a smaller pill 32 would not stabilize upon shuffling or arrangement by spatula. In this way, shuffling, brushing or moving via spatula those pills in tray 100 may serve as another pill discrimination methodology according to the various embodiments disclosed herein.

A tray 100 may be molded so that a precise alignment among pills 34 and 35 may be achieved when poured into a tray 100. Groove 52 may be shaped or formed so that pills of an exact size and shape may fit side-by-side following a shuffle or brush or spatula stroke.

Alternatively, peaks 53 and dividers 54 may separate pills 36 and 37 so that a user can clearly identify whether the proper pills are in the bay. Finally, a cavern 55 may be made of a flexible material to cover a correct pill so that incorrect pills cannot displace the correct pill 38 and cannot be covered as well. While these examples of bay 50 formations and floor 110 arrangements are proposed, variations or use of several flexible structures on floor 110 may be realized in order to hold particular contents, such as pills, medicines and capsules, and exclude others.

In an example of the use of any trays disclosed herein, a pharmacist may select a group of pills for a patient. Rather than count every pill in the container by hand, the pharmacist may pour the contents of the container onto an appropriate tray 100 to see whether she has the proper number of pills and that the pills match the shapes of the bays in the surface of the floor of the tray. If the requisite number and type of pill is confirmed by inspection using tray 100, the pharmacist may bend the tray at its floor or at its side walls and pour the pills back into the container to provide the patient. In this manner, a medical practitioner can inspect pills of a container and return each pill back to the container without ever touching the pills with their hands. This same inspection process may be undertaken by elderly patients and parents of children to confirm accuracy of their medications.

A tray 100 may also be used to identify incorrect pills by virtue of their misalignment or incomplete fit within the bays 50 of a given tray. In this way, a practitioner or medicine user may identify whether the batch of pills poured onto a tray contains incorrect pills. Further, use of model pill 40 may further enhance the pill discrimination process as between pills that are close in certain dimensions. Users may compare pills to the model pill 40 to ensure each pill is properly part of their medication regimen. Where individuals take a variety of pills, multiple trays may be used to sort out the proper pills to be taken and ensure they are not mistakenly being taken out of order.

Figure 11:
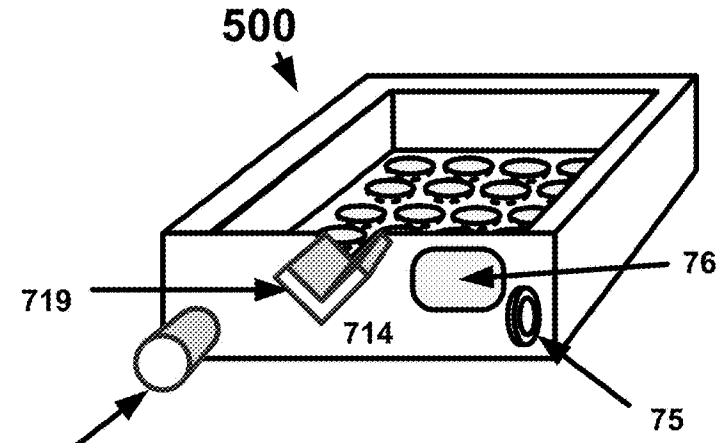
FIG. 11 illustrates an alternative embodiment of a tray with exemplary attachments.

FIG. 11 illustrates a tray 500, which may be the same as or similar to any of the trays disclosed herein in type and combination. Tray 500 possesses a front wall 714 with a spout 719, a toggle 74, a ring 75 and engraving 76. As previously described with respect to spout 719, toggle 74, ring 75 and engraving 76 may be made from the same or similar molding processes used for tray 500. In on example, any of the spout 719, toggle 74, ring 75 and/or engraving 76 may be molded from the same material as tray 500, molded from a different material and attached to tray 500 or molded from the same material and attached to tray 500, using any of above-disclosed mechanical or chemical attaching methods. A user of tray 500 may use any of spout 719, toggle 74 or ring 75 to shuffle tray 500 to sort pills 30 or 33 so that they are properly situated in their respective bays.

Toggle 74 may be used to move a tray 500 back and forth to shuffle pills 30 and 33 into their proper bay 50 configurations. Having a smooth surface under tray 500 may be advantageous for use of toggle 74 to shuffle tray 500 on a smooth surface, e.g., a countertop. Ring 75 may be used in like fashion to toggle 74, but may have an additional use as a means of twisting or flexing tray 500 to allow for pills or other contents to exit from the bays. For example, rings 75 located at the left corner of a back wall of tray 500 and the right corner of a front wall of tray 500 may be pulled by a user so that a rectilinear tray 500 takes on a rhomboid shape. A user may then pour pills located within tray 500 from one of acute vertices of rhomboid tray 500 and back into a container or other location. Use of rings 75 in this way may be enhanced when using flexible material to fabricate tray 500.

Engraving 76 may be any type of molded engraving in tray 500 flexible material that contains words, descriptions or symbols. For instance, engraving 76 may set forth the type of drug for which its bays are configured to receive. It may provide additional medical information regarding the pills or capsules it can hold. Engraving 76 may provide any number and form of useful information to the user of a tray 500, e.g., engraved pictures of pills, dosage information or other identification indicia on a given pill.

As described with respect to various trays 100-500 and 800, a variety of materials and in a variety of colors may be utilized to achieve the various aspects described. Using a flexible material such as silicone or rubber for all components of an exemplary tray 100-500 and 800 may allow for easier storage (e.g., rolling up a tray and placing into a tube for later use), ease of cleaning, increased durability and longevity of use. For purposes of molding, a rubber or silicone tray may be formed with little expense, ease of manufacture and short processing times. Softer, flexible materials may be easier to cut or shape to suit particular tray arrangements, forms and uses. While flexible materials may have certain advantages, alternative materials may be suitable depending on application of a particular tray, e.g., plastic trays used to hold liquid materials that may resist absorbing or liquid adhering to its bay or floor surfaces.

To further aid in discrimination of contents fitting within an exemplary tray bay 50, the flexible tray material may be a color or colors which provide contrast to the target contents of bays 50. For example, in an exemplary tray 100, tray 100 may be made out of a grey silicone so that a user may more efficiently depict Lipitor®, a white pill.

Many further variations and modifications may suggest themselves to those skilled in art upon making reference to above disclosure and foregoing illustrative embodiments, which are given by way of example only, and are not intended to limit the scope and spirit of the interrelated embodiments of the invention described herein.

The invention claimed is:

1. A medicinal storage system comprising:

a tray having at least one flexible wall extending above and around at least one medicinal product, wherein the at least one medicinal product is held in place above by a flexible cavern structure and the at least one flexible wall extends above an uppermost part of the flexible structure; and a plurality of protrusions extending perpendicularly from the at least one flexible wall, wherein at least two of the plurality of protrusions are diagonally opposite one another about the at least one flexible wall.

2. The medicinal storage system of claim 1, wherein at least two of the plurality of protrusions has at least four surfaces.

3. The medicinal storage system of claim 1, wherein the at least one flexible wall extends outwardly as it is extending above and around the at least one medicinal product.

4. The medicinal storage system of claim 1, further comprising a storage container for the tray.

5. The medicinal storage system of claim 2, further comprising a storage container for the tray.

6. The medicinal storage system of claim 3, further comprising a storage container for the tray.

7. A flexible tray system, comprising:

at least one flexible wall having a plurality of protrusions, wherein at least two of the plurality of protrusions are diagonally opposite one another about the at least one flexible wall;

at least one edible object held in place above by a flexible structure, wherein the at least one flexible wall is taller than the flexible structure;

and a storage container for the tray.

8. A dispensing method, comprising the steps of:

pressing or pulling at least two protrusions extending substantially perpendicularly from a flexible wall of a tray, wherein the flexible wall extends above and around at least one edible product, wherein at least one of the at least two protrusions is on a side of the tray opposite of another protrusion;

bowing the flexible wall either inwardly or outwardly; and moving the tray with the at least one edible product while the flexible wall is bowed.

9. The dispensing method of claim 8, wherein the at least two protrusions are diagonally opposite one another about the flexible wall.

10. The dispensing method of claim 8, further comprising the step of inserting the tray into a container.

11. The dispensing method of claim 9, further comprising the step of inserting the tray into a container.

12. The dispensing method of claim 8, further comprising the step of removing the tray from inside a container, wherein the at least two protrusions are diagonally opposite one another about the flexible wall.

13. The dispensing method of claim 9, further comprising the step of removing the tray from inside a container.

14. The dispensing method of claim 10, further comprising the step of removing the tray from inside the container, wherein the at least two protrusions are diagonally opposite one another about the flexible wall.

15. The dispensing method of claim 11, further comprising the step of removing the tray from inside the container.

16. The dispensing method of claim 15, wherein the step of inserting the tray into the container comes after removing the tray from inside the container.

17. The dispensing method of claim 8, wherein the flexible wall bows at a portion of the flexible wall proximal to one of the at least two protrusions.

18. The dispensing method of claim 17, wherein the flexible wall bows at two portions each of which is proximal to one of the at least two protrusions.

19. The dispensing method of claim 18, wherein the at least two protrusions are diagonally opposite one another about the flexible wall.

20. The dispensing method of claim 19, further comprising the steps of:

inserting the tray into a container; and removing the tray from the container.

* * * * *